US008505651B2

(12) United States Patent
Brandt et al.

(10) Patent No.: US 8,505,651 B2
(45) Date of Patent: Aug. 13, 2013

(54) ANCHOR SYSTEM AND METHOD FOR ANCHORING A TOOL WITH A POSITIONAL BIAS

(75) Inventors: Nathan J. Brandt, Oklahoma City, OK (US); David B. Haughton, Houston, TX (US); John P. Davis, Cypress, TX (US); Christopher W. Guidry, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 344 days.

(21) Appl. No.: 12/761,126

(22) Filed: Apr. 15, 2010

(65) Prior Publication Data

US 2011/0253386 A1 Oct. 20, 2011

(51) Int. Cl.
*E21B 7/08* (2006.01)

(52) U.S. Cl.
USPC ..... 175/81; 166/117.6; 166/177.5

(58) Field of Classification Search
USPC ..... 166/117.5, 117.6, 382; 175/61, 175/81, 82
See application file for complete search history.

(56) References Cited

U.S. PATENT DOCUMENTS 2,766,010 A * 10/1956 Gibbs ..... 166/117.6
3,029,874 A * 4/1962 Turman ..... 166/212
5,042,597 A * 8/1991 Rehm et al. ..... 175/61
5,341,873 A * 8/1994 Carter et al. ..... 166/117.5
5,452,759 A 9/1995 Carter et al.
5,474,126 A 12/1995 Lynde et al.
5,988,286 A * 11/1999 Dwiggins ..... 166/382
6,026,899 A 2/2000 Arizmendi et al.
6,755,248 B2 6/2004 Toulouse et al.
7,077,206 B2 * 7/2006 Kennedy et al. ..... 166/313

OTHER PUBLICATIONS

International Search Report and Written Opinion; International Application No. PCT/US2011/031769, Date of Mailing Nov. 15, 2011, Korean Intellectual Property Office; International Search Report 8 pages; Written Opinion 3 pages.
"Anchors," [online]; [retrieved Jul. 7, 2010]; retrieved from the Internet: http://www.bakerhughes.com/products-and-services/completions-and-productions/wellbore-intervention/casing-exits/anchors.
"Casing Exit Systems," Baker Hughes Incorporated, Sep. 2004.
Cundiff, David W., "Open/Cased Hole Inflatable Whipstock Anchor," [Abstract Only], SPE Production and Operations Symposium, Mar. 24-27, 2001, Oklahoma City, Oklahoma.
"Torquemaster Bottom Trip Retrievable Anchor," Product Family No. H15054, Whipstock Systems, Anchors, and Retrieving Tools, Baker Oil Tools, pp. 79-80.

* cited by examiner

*Primary Examiner* — Giovanna Wright
*Assistant Examiner* — Richard Alker
(74) *Attorney, Agent, or Firm* — Cantor Colburn LLP

(57) ABSTRACT

An anchor system including a housing having a radial opening therein. A piston disposed within the housing and translatable therein. A slip in operable communication with the piston such that translation of the piston axially of the housing causes movement of the slip radially of the housing. The slip having a contact face that is nonparallel to an axis of the housing and nonparallel to a surface against which the slip is configured to be set. A method for anchoring a tool is included.

16 Claims, 6 Drawing Sheets

ANCHOR SYSTEM AND METHOD FOR ANCHORING A TOOL WITH A POSITIONAL BIAS

BACKGROUND

In the downhole drilling and completion industry it is often necessary to place tools in a selected position within a borehole, cased or open, for various purposes. To locate and anchor such tools in the selected position the art has known many different forms of securement each of which has inherent benefits and weaknesses. Selection of one of the many forms of securement is within the purview of the designer for the ultimate system and takes into account one or more parameters of the environment, operating conditions, etc. in the intended location.

One common form of anchoring system uses a plurality of "slips" that are urged radially outwardly by a conical ramp on a mandrel to engage an inside surface of a borehole in which the anchor is to be set. Tools are reliably centered in the borehole using this anchoring configuration.

In view of the nearly endless possible situations in which tools may need to be anchored, the art is always receptive to new anchoring arrangements.

SUMMARY

An anchor system including a housing having a radial opening therein; a piston disposed within the housing and translatable therein; and a slip in operable communication with the piston such that translation of the piston axially of the housing causes movement of the slip radially of the housing, the slip having a contact face that is nonparallel to an axis of the housing and nonparallel to a surface against which the slip is configured to be set.

A method for anchoring a tool with a positional bias including attaching a tool to an anchoring system having a slip with a contact face that is nonparallel to a surface against which it is to be set; deploying the slip at a target location in a borehole; and causing an uphole end of the tool to be biased against a selected portion of the borehole, the portion being related to the orientation of the slip and the contact face of the slip.

A method for anchoring a tool with a positional bias including attaching a tool to an anchoring system having a slip with a contact face that is angled relative to an axis of the tool and anchoring system; deploying the slip at a target location in a borehole; causing an uphole end of the tool to be biased against a selected portion of the borehole, the portion being related to the orientation of the slip and the contact face of the slip.

BRIEF DESCRIPTION OF THE DRAWINGS

Referring now to the drawings wherein like elements are numbered alike in the several Figures.

DETAILED DESCRIPTION

Figure 1:
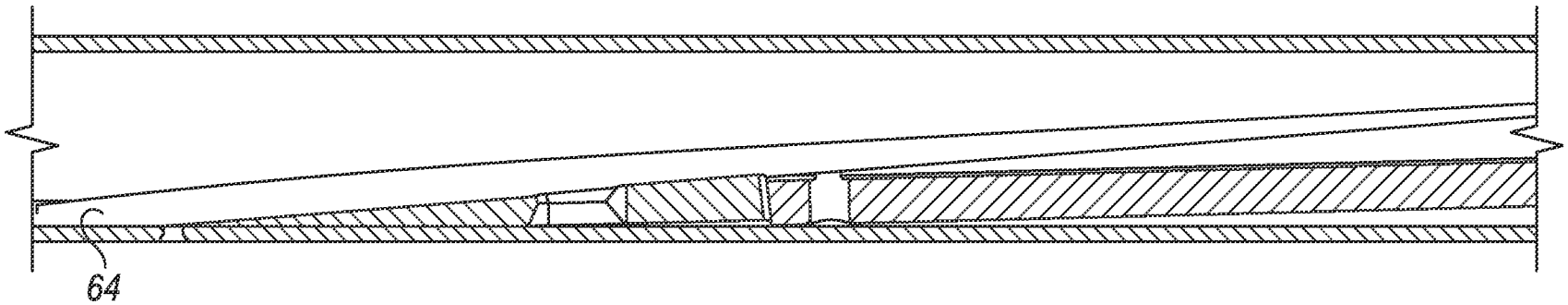
FIGS. 1 and 2 are together an extended view of an anchor system and tool.
Figure 2:
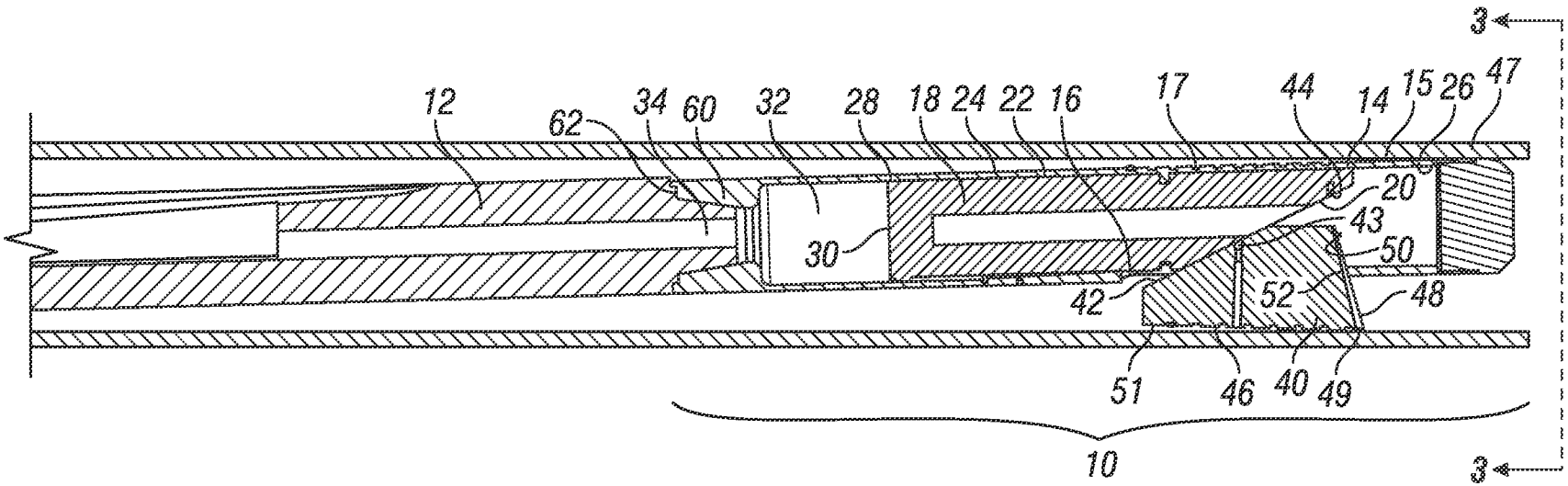

Referring to FIGS. 1 and 2 simultaneously an anchor system 10 is illustrated. A tool 12 (illustrated as a Whipstock but not limited thereto) is attached to the system 10. The anchor system 10 and tool 12 are illustrated in a set position. The anchoring system 10 includes a housing 14 of a tubular nature, the housing including a radial opening 16 positioned to allow radial translocation of objects or fluid through a wall of the housing. The housing 14 further includes a contact surface 15 having a gripping configuration 17, which may comprise wickers, bumps, roughness, etc.

Figure 6:
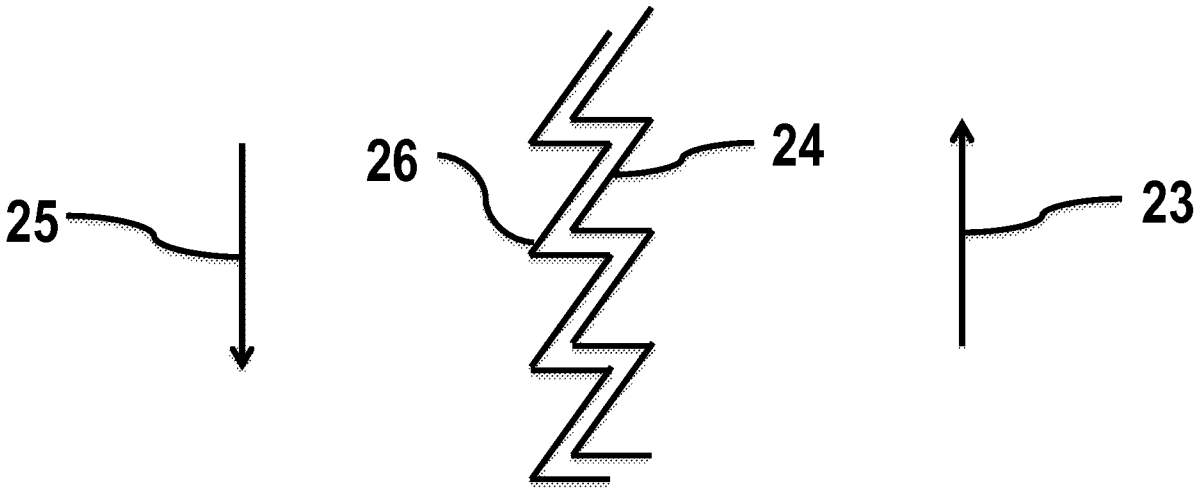
FIG. 6 is a cross-sectional view of a unidirectional configuration between a piston and housing of the anchoring system.

Within the housing 14 is disposed a piston 18 having an angled wedge face 20. A slip 40 is also at least partially disposed within the housing, the slip 40 having an angled wedge follower face 42 complementary to and in communication with face 20. The piston 18 includes at an outside dimension surface 22 thereof a unidirectional configuration 24 such as a wicker thread or wicker follower with the other of the wicker thread or wicker follower being disposed upon an inside dimension surface 26 of the housing, for example, as shown in FIG. 6. The wicker thread and wicker follower or other similar configuration work together to permit movement of the piston 18 in one direction 23 relative to the housing 14 thereby preventing movement in the opposite direction 25. The wicker thread and wicker follower in that embodiment ratchet past each other in one direction 23 and cannot move relative to one another in the other direction 25. Further the piston includes a seal configuration 28 that interacts with the housing surface 26 to prevent fluid moving between the piston 18 and housing 14. An end of the piston 18 is closed forming a piston crown 30 that along with the housing 14 defines a chamber 32 that may be changed in volume through the application of fluid pressure and the consequent movement of the piston 18 toward the slip. An inlet 34 is provided into the chamber 32 for the introduction of fluid at a selected time related to deployment of the anchor 10.

During run in, the slip 40 is disposed at the angled wedge face 20 of the piston 18. Although the slip is illustrated in the set position, it is evident what the position of the slip is in the run in position from the relative positions of the portions of the release member 43/44 that are seen in this view as parted. Release member 43/44 is a single configuration in the run in position affixing the slip 40 to the piston 18. The release member may be a shear member and dictates the position of the slip during run in.

The slip 40 itself includes a contact face 46 intended to extend into contact with a casing 47 or open hole. The face 46 is specifically configured to be angled relative to a surface against which it is to set and/or nonparallel to an axis of the housing 14. It is to be understood that these two conditions can occur in the same embodiment. This is illustrated in FIG. 2 since the downhole end of the slip at point 49 is in contact with the casing 47 and the uphole end of the slip at point 51 is not in contact with the casing 47. This is particularly distinct from prior art slips in that prior art slips would have contact faces that are intended to be parallel with the casing or open hole and are parallel to an axis of the anchor of which they form a part. The angle of the contact face to an expected interfacing surface is to be within a range of about 1 degree to about 10 degrees. In alternate embodiments the angle of the contact face to an axis of the housing is to be within a range of about 1 degree to about 10 degrees.

The slip 40 further includes an angled downhole end 48 that is interactive with a downhole end 50 of the opening 16. The end 50 includes a chamfer 52 as shown. This configuration assists in the reduction of friction between the slip 40 and the opening 16. As will be appreciated by one of skill in the art from the foregoing and a view of FIG. 2, a significant amount of force will exist between the slip and the downhole end of the opening 16 due to the downhole direction urging of the piston 18. Creating the chamfer 52 and the angled downhole end 48, will change the vector at which the urging from the piston 18 impacts the subject interface (between the opening and the slip) and hence reduces the effective frictional bind that would otherwise occur thereby reducing the amount of fluid pressure required to be delivered to chamber 32 in order to set the anchor system.

Operation of the device, system and tool, comprises attaching the tool 12 to the anchor system 10 at a thread 60. Orientation of the tool 12 to the anchor system 10 is adjusted using a spacer 62 interposed at the thread 60 such as a washer. One of skill in the art will understand that a washer interposed in a threaded connection will cause the threaded connection to be engaged to a different degree than it would be without the washer or spacer and hence an orientation of one end of the threaded connection to the other end of the threaded connection is adjustable by the thickness of the spacer. The degree to which orientation changes with various thicknesses of spacers is related to the pitch of the thread used. In one embodiment, the thread is an acme type thread and spacers used will be of a range of thicknesses depending upon the number of degrees of rotational orientation from fully threaded that is desired. In an exemplary embodiment, the degree of orientation change is related to the thickness of the spacer as 180 degrees of rotation per .188 inch of thickness.

Once the desired orientation of the tool 12 to the anchor system 10 is achieved through selection and installation of the appropriate spacer 62, the entire assembly is run in the hole to target depth. Upon reaching target depth fluid is pressurized to expand chamber 32 by urging piston 18 downhole toward the slip 40. As piston 18 moves, the release member 43/44 is loaded substantially in shear and will shear at a preselected value. After the member 43/44 shears, the slip will move radially outwardly of the housing 14 through the opening 16 based upon the angled surface 20 interacting with the angled wedge follower face 42. This continues until the slip contact face 46 seats against casing 47 or the open hole and fluid pressure builds at surface to indicate that the set is complete.

Due to the angle of the contact face 46 as disclosed, the tool 12 attached to the anchor system 10 will be biased to one surface of the casing 47 or open hole. More specifically, the slip 40 contact face 46 will "want" to flatten out against the casing 47 or open hole and assume a parallel position thereagainst. Since it cannot easily do this due to the angle of the contact face 46, the impetus to do so must be transmitted to another part of the assembly. This part will be the uphole end of the tool 12 connected to the system 10.

Because the anchor system can be oriented relative to the tool 12, the direction of bias can be controlled and put to advantage. As illustrated in FIGS. 1 and 2, it can be seen that where the slip is oriented to extend on the same side of the whole assembly that the back of the Whipstock is on, the back of the Whipstock is urged against the casing 47. More specifically and referring to FIGS. 1 and 2, and further assuming for purposes of explanation and clarity only (no limitation is to be inferred) that the casing 47 happens to be in a horizontal borehole so that the reader is able to easily place the figures side by side and view them as numbered, the slip 40 extends from the housing 14 downwardly and the Whipstock is oriented with its face upwardly. The angle of the contact face 46 of the slip 40 will cause the uphole end 64 of the tool 12 (Whipstock here) to be tightly urged against the casing 47 on the same side as the slip 40 is on. In the example set up for the readers benefit, the end 64 is at the bottom of the drawing since the slip is at the bottom of the drawing but of course the system and tool could be oriented to be biased toward the top of the casing as viewed in the drawings. This is important particularly in the case of an actual highly deviated or horizontal borehole as it is sometimes of interest to a well operator to create a "low exit" which in the vernacular means that the operator wants to mill a window in the side of the casing that is lower using gravity as a reference. Problems with the prior art will allow the end 64 of the Whipstock for example to tend to sag with gravity and get in the way of the mill that is to be used after setting of the anchor and tool. This can create problems for the operator. In the anchor system 10 as disclosed herein however, the end 64 can be biased securely to the side of the casing or open hole that is opposed to gravity because of the action of the contact face 46 of the slip. In a situation as described the anchor 10 and tool would be rotated substantially 180 degrees from the position shown in FIGS. 1 and 2 so that the slip 40 would extend upwardly in the drawing and the Whipstock end 64 would be at the top of the drawing against casing 47.

Figure 3:
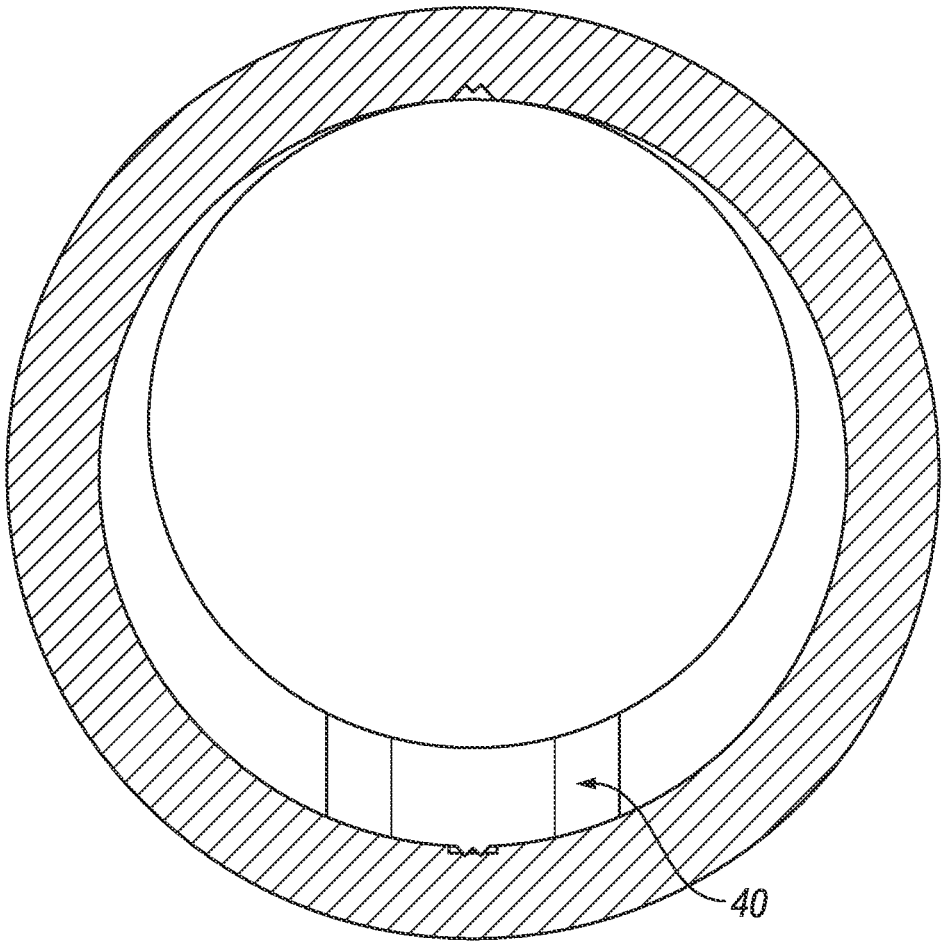
FIG. 3 is an end view of the anchoring system of FIG. 2 taken along line 3-3.
Figure 4:
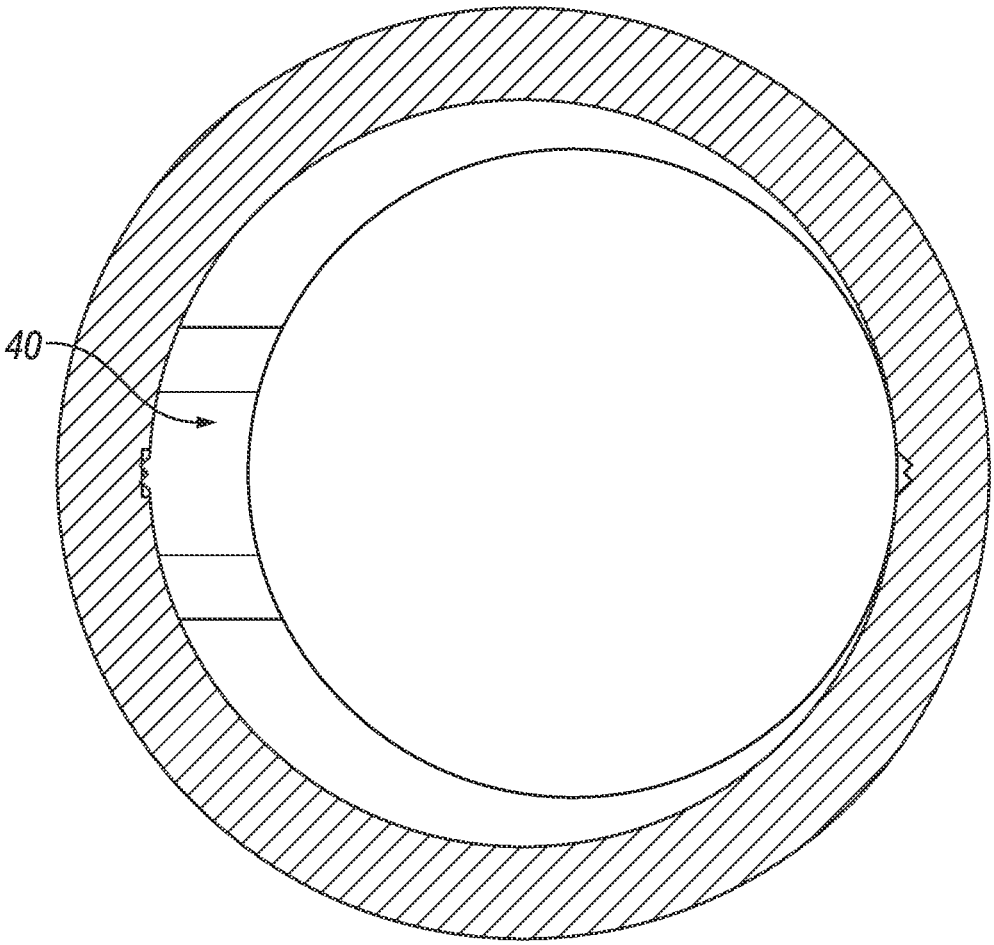
FIG. 4 is an end view of the anchoring system of FIG. 2 taken along line 3-3 in an alternate orientation.
Figure 5:
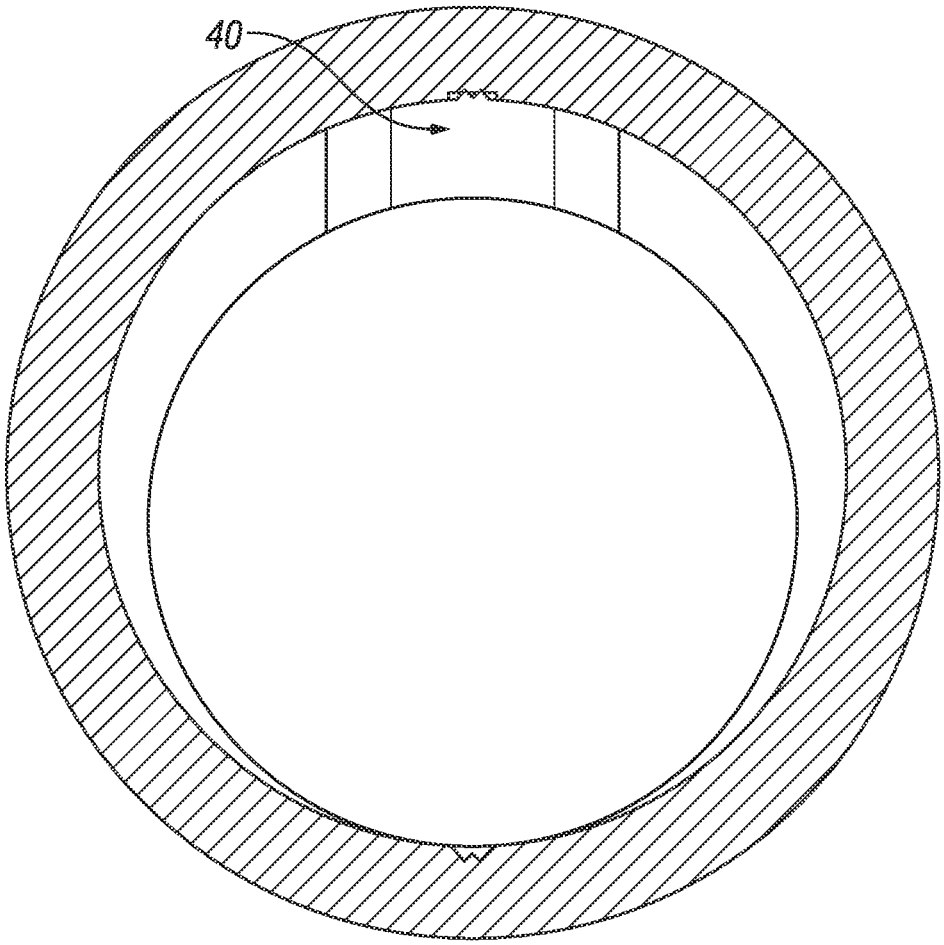
FIG. 5 is an end view of the anchoring system of FIG. 2 taken along line 3-3 in another alternate orientation.

Because the slip 40 can be oriented as desired relative to the tool 12 as discussed above, an uphole end 64 of whatever tool 12 is used can be biased in any direction that is desired. The orientation configuration is illustrated with three other views of the slip from a downhole end of the system 10 in FIGS. 3-5.

It is noted that although a fluid pressure configuration is illustrated, the anchor system 10 can be actuated with other means such as a lead screw, set down weight, explosive devices, etc.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. An anchor system comprising:

a housing having a radial opening therein;

a piston disposed within the housing and translatable therein; and a slip initially affixed to the piston by a release member, the slip in operable communication with the piston such that translation of the piston axially of the housing causes movement of the slip radially of the housing, the slip while in a non-set position having a contact face that is nonparallel to an axis of the housing and nonparallel to a surface against which the contact face is configured to be set when in a set position, the contact face configured to bias a tool attached to the system to one surface of a casing or open hole in which the system is set during use.

2. An anchor system as claimed in claim 1 wherein the housing includes a contact surface.

3. An anchor system as claimed in claim 2 wherein the contact surface includes a gripping configuration.

4. An anchor system as claimed in claim 1 wherein the piston includes an angled wedge face.

5. An anchor system as claimed in claim 4 wherein the slip includes an angled wedge follower face interactive with the angled wedge face.

6. An anchor system as claimed in claim 1 wherein movement of the piston is permitted in one direction relative to the housing and prevented in an opposite direction thereof.

7. An anchor system as claimed in claim 1 wherein the release member is a shear member.

8. An anchor system as claimed in claim 1 wherein the system includes a spacer disposed between the system and the tool attached thereto to adjust a rotational orientation of the tool to the system.

9. An anchor system as claimed in claim 8 wherein the rotational orientation of the tool to the system changes by 180 degrees per 0.188 inch thickness of the spacer.

10. An anchor system as claimed in claim 1 wherein the contact face has an angle ranging from about 1 degree to about 10 degrees to the axis of the housing.

11. An anchor system as claimed in claim 1 wherein the contact face has an angle ranging from about 1 degree to about 10 degrees to the surface against which the slip is configured to be set.

12. An anchor system comprising:

a housing having a radial opening therein, the radial opening including a chamfered downhole edge;

a piston disposed within the housing and translatable therein; and a slip in operable communication with the piston such that translation of the piston axially of the housing causes movement of the slip radially of the housing, the slip while in a non-set position having a contact face that is nonparallel to an axis of the housing and nonparallel to a surface against which the contact face is configured to be set when in a set position, the contact face configured to bias a tool attached to the system to one surface of a casing or open hole in which the system is set during use.

13. An anchor system as claimed in claim 12 wherein the slip is initially affixed to the piston by a release member.

14. An anchor system as claimed in claim 12 wherein the slip includes an angled end cooperative with the chamfered downhole edge.

15. A method for anchoring a tool with a positional bias comprising:

attaching a tool to an anchoring system having a housing having a radial opening therein, a piston disposed within the housing and translatable therein, and a slip initially affixed to the piston by a release member and disposed within the housing in a run-in condition, the slip having a contact face that is nonparallel to a surface against which the contact face is to be set;

deploying the slip at a target location in a borehole; and causing an uphole end of the tool to be biased against a selected portion of the borehole, the portion being related to the orientation of the slip and the contact face of the slip.

16. A method for anchoring a tool with a positional bias comprising:

attaching a tool to an anchor system as claimed in claim 1 wherein the contact face of the slip is angled relative to an axis of the tool;

deploying the slip at a target location in a borehole; and causing an uphole end of the tool to be biased against a selected portion of the borehole, the portion being related to the orientation of the slip and the contact face of the slip.

* * * * *